United States Patent [19]

Palmer

[11] Patent Number: 4,611,808

[45] Date of Patent: Sep. 16, 1986

[54] STATISTICAL INFORMATION GATHERING

[75] Inventor: Robert L. Palmer, Birchgrove, Australia

[73] Assignee: Ainsworth Nominees Pty. Limited, Rosebery, Australia

[21] Appl. No.: 554,530

[22] Filed: Nov. 23, 1983

[30] Foreign Application Priority Data

Nov. 29, 1982 [AU] Australia ..... PF7026

[51] Int. Cl.[4] ..... A63F 7/00

[52] U.S. Cl. ..... 273/138 A; 273/143 R

[58] Field of Search ..... 273/138 R, 138 A, 139 R, 273/143 R, DIG. 28

[56] References Cited

U.S. PATENT DOCUMENTS

| | | | |
|---|---|---|---|
| 4,111,421 | 9/1978 | Mierzwinski | 273/DIG. 28 |
| 4,133,034 | 1/1979 | Etter | 364/464 |
| 4,335,809 | 6/1982 | Wain | 273/138 A |

FOREIGN PATENT DOCUMENTS

| | | | |
|---|---|---|---|
| 1542284 | 3/1979 | United Kingdom | 273/138 A |

*Primary Examiner*—Leo P. Picard

*Attorney, Agent, or Firm*—Murray and Whisenhunt

[57] ABSTRACT

A system of collecting data accumulated by a poker machine and relating to the operation of the poker machine, the system comprising a plurality of poker machines each of which has a control unit (1) which is adapted to collect and store data during its normal operation and to transmit this data in the form of modulated light (5) upon receipt of suitable external stimulus such as the operation of a switch (2) on the poker machine, a portable receiver adapted to receive the transmitted signal and to store this data in a memory (15). In this way data is collected from each poker machine in the particular installation all of the data being stored temporarily in the memory (15) of the portable receiver. Once data from all machines in the system has been collected or once the storage (15) in the receiver unit is full, the data is then dumped into a computer, or printed out on a printer (16), via a communications cable which can be connected to the receiver unit.

19 Claims, 5 Drawing Figures

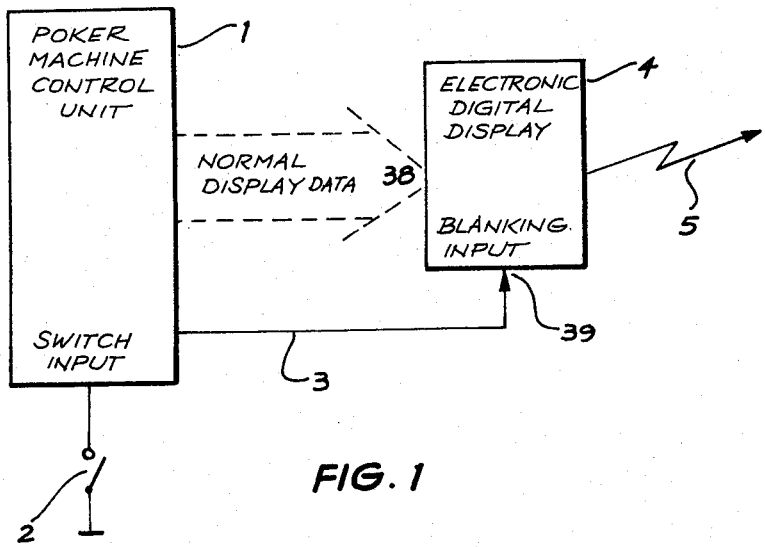
FIG. 1
FIG. 2
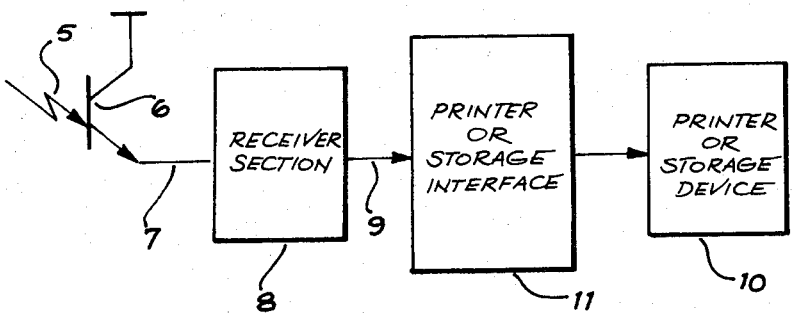

STATISTICAL INFORMATION GATHERING

The present invention relates to poker machines, otherwise known as fruit machines, and in particular to the collection of audit data from such machines.

Audit data concerning the day to day operation of poker machines is required for the keeping of proper accounting records, and to discourage fraudulent manipulation of such machines. Audit data would normally include the amount of money inserted into the machine by players, the amount paid out by the machine, the number of "jackpots" or other large pays by coin made by the machine, as well as other relevant data.

Several methods are currently in use to collect audit data from poker machines. The most commonly used of these methods are a manual system and a "landline" system.

The manual system of data collection requires that the poker machine be fitted with a display which can be accessed by the person charged with the responsibility of collecting the data. This display could either be in the form of a number of mechanical counters which were incremented as a result of various occurences within the machine, or alteratively they could be in the form of an electronic display controlled by the poker machine's central control unit. In the latter case the data would be collected by the control unit during normal operation of the machine, and displayed on the display in response to a particular stimulus such as the operation of a key switch. With this system of data collection, data is recorded by hand and errors often occur. Further the process of recording the data is time consuming and therefore expensive.

The landline system of data collection involves connecting each poker machine in an installation to a central data-logging system via cables, allowing digital communication between each poker machine control unit and the data-logger. This sytem allows rapid and continuous collection of data, but is expensive to install due to the amount of cabling required, and is also prone to wilful or accidental damage. As well as this, cable connectors are a regular source of failure in electronic systems, and this problem is accentuated in hostile environments such as those which would exist in poker machine installations where equipment is subjected to public use and abuse.

Almost without exception poker machines of contemporary design are fitted with electronic digital displays which show payouts made by the machine and/or the number of coins in credit by the player.

The data displayed on each of these displays is produced under the control of the poker machine's central control unit, which in contemporary machines is microprocessor based.

One form of the present invention makes use of a microprocessor controlled electronic display in a contemporary poker machine to provide a means for transmitting the audit data accrued by a poker machine by modulating the light output of the electronic display with a modulation signal produced from the encoded audit data held in the machine's Central Control Unit. Transmission of audit data is initiated by the operation of a switch.

Although there is an obvious advantage in using light as the modulated carrier signal, in that the microprocessor controlled displays are already provided on most contemporary poker machines, the invention is not limited to this form of transmission and in particular, transmissions could be by any form of electro-magnetic radiation, audible tones, or alternatively by way of an electric or magnetic field.

Data transmitted by a poker machine of the present invention may be gathered and recorded in a number of ways. The modulated carrier transmitted by the machine is received by a suitable transducer (a photo-optic device in the case of modulated light transmission) which converts the transmitted signal back into an electrical signal which is in turn decoded to reproduce the original digital data collected by the poker machine control unit. Once decoded the data may be processed in any one of the following ways:

1. Direct storage in electronic memory.
2. Storage on magnetic storage medium such as disk or tape.
3. Direct output to printer.
4. Reformatting of data to a form suitable for communication with a computer either directly or by telephone line.

According to a first aspect, the present invention consists in a poker machine or fruit machine comprising:

a central control unit adapted to collect and store audit data while said machine is being played, to encode said data into a form suitable for serial transmission and to use said encoded data to generate a serial data signal;

transducer means adapted to generate a carrier signal and responsive to said serial data signal to modulate said carrier signal with said serial data signal; and switch means adapted to enable and disable the transmission of said data.

The carrier signal produced by the transducer means can be in the form of electromagnetic radiation, an electric field, a magnetic field or an acoustic tone, however, in a preferred form of the invention the carrier signal is in the form of visible light.

In various forms of the invention either direct modulation of the carrier or modulation of a subcarrier may be employed, however, in the preferred form the light produced by the transducer means is amplitude modulated directly by the serial data signal using a modulation ratio of 100%.

Data may be encoded by any one of the standard encoding systems such as ASCII, EBCDIC or Baudot, however, the invention is not limited to the use of standard encoding systems and any suitable method of encoding data may be employed.

According to a second aspect, the present invention consists in a poker machine or fruit machine comprising: a central control unit adapted to collect and store audit data while said machine is being played, to encode said data, and to generate one or more data signals representing said encoded data;

modulating means adapted to modulate carrier signals in response to the one or more data signals each of said carrier signals being modulated by one of said one or more data signals; and transducer means adapted to transmit said carrier signals.

In one embodiment of the invention data is encoded in a two of eight code and the carrier signals comprise the eight frequencies used in a Dual Tone Multi-frequency encoding system. In this embodiment the carrier signals are preferably combined and fed to a speaker to produce a set of audible tones. Other forms of the invention are possible, however, and in particular the carrier signls may form a set of sub-carrier signals which are combined and used to modulate an electromagnetic carrier signal such as visible light.

According to another aspect, the present invention consists in a portable receiver unit for collecting data transmitted by a poker machine or fruit machine, said data being modulated on a carrier signal or a plurality of carrier signals, said receiver comprising:

signal detecting means to receive said carrier signal or signals and to decode said signal or signals to recover the transmitted data;

storage means to hold said data; and communication means adapted to enable said stored data to be connected to a computer, a printer or a bulk storage unit and to transmit said data to said computer, printer or bulk storage unit.

According to still another aspect the present invention consists in a portable receiver for collecting data transmitted by a poker machine or fruit machine, said data being modulated on a carrier signal or a plurality of carrier signals, said receiver comprising:

signal detecting means to receive said carrier signal or signals and to decode said signal or signals to recover the transmitted data;

interface means to convert said data into a form capable of storage on magnetic tape; and magnetic tape storage means.

According to a further aspect the present invention consists in a poker machine or fruit machine installation comprising a plurality of poker machines or fruit machines each one of said plurality of machines being adapted to transmit signals encoded with audit data collected within said one of the plurality of machines, the installation further comprising receiver means to receive said transmitted signals and to convert them into electrical signals, and decoder means to convert said electrical signals into one or more digital signals representing the audit data, means being provided to print said audit data or to store said audit data in a digital form.

In a preferred embodiment of the invention the receiver means includes electronic storage elements to directly record signals transmitted by a poker machine. In other embodiments the electronic storage elements can be replaced by magnetic storage means such as a tape recorder or disc drive.

Embodiments of the invention will now be described by way of example with reference to the accompanying drawings in which:

FIG. 1 illustrates a block diagram of a transmitter of the present invention;

FIG. 2 illustrates a block diagram of a signal receiver of the present invention;

Figure 3:
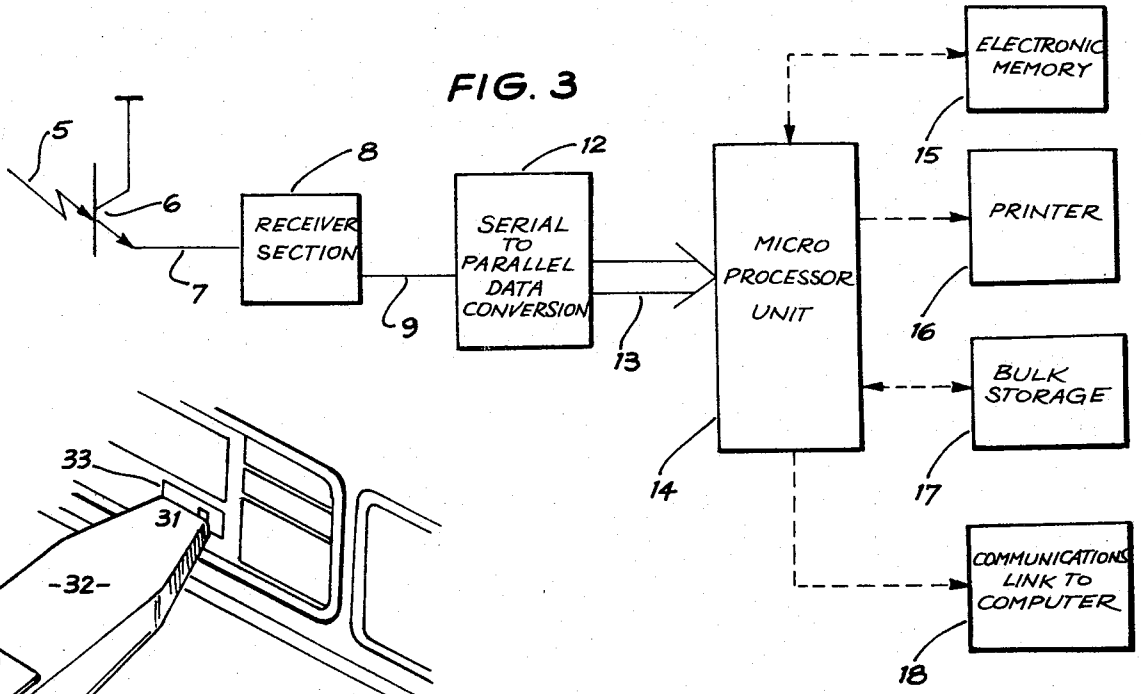
FIG. 3 illustrates a block diagram of a possible receiver for use with the transmitter of FIG. 1.

Referring to FIG. 1, a poker machine incorporating the present invention has a microprocessor based control unit 1 which is used to control the majority of poker machine functions. The control unit gathers audit data while controlling the operation of a poker machine, and then stores the audit data until it is required. Upon operation of a switch 2, the contact of which is connected to the microprocessor 1, the microprocessor begins to generate a serial bit stream 3 encoded with the audit data. This bit stream is fed to the blanking input 39 of an electronic digital display 4 such that the light output 5 of the display is 100% amplitude modulated with the bit stream signal. The normal display data 38 will be set to a constant display valve during data transmission.

In order to receive the signals transmitted by the arrangement of FIG. 1 a receiver system as seen in FIG. 2 is used. This receiver system has a photo-optical device 6 such as a phototransistor to convert the transmitted light pulses into electrical signals which are then conditioned in a receiver section 8 to reproduce a serial data signal 9 corresponding to the original bit stream signal 3. The serial data signal 9 is then fed to a printer or storage system 10 via a suitable interface 11.

A preferred receiver arrangement is shown in FIG. 3 in which the photo-optic device 6 and receiver section 8 are as previously described with regard to FIG. 2. The serial data 9 from the receiver section 8 is then converted to parallel data 13 in a serial to parallel data conversion circuit 12 a standard communications interface device. The parallel data 13 is then fed to a microprocessor 14. In an alternative arrangement the parallel to serial conversion is achieved within the microprocessor 14, the serial data signal 9 being fed directly to a serial input of the microprocessor unit.

Within the microprocessor 14 the data is decoded or reformatted as necessary for storage in electronic memory 15 or transmission via a suitable interface to a printer 16, a bulk storage device 17 or via a suitable communications link 18 to a central computer.

In the case where data is stored either in electronic memory 15 or in a bulk storage device 17 such as cassette recorder, the data may be retrieved at a later time for transmission to a printer or over a data link 18 to a computer system in which automatic accounting procedures may be performed.

Figure 4:
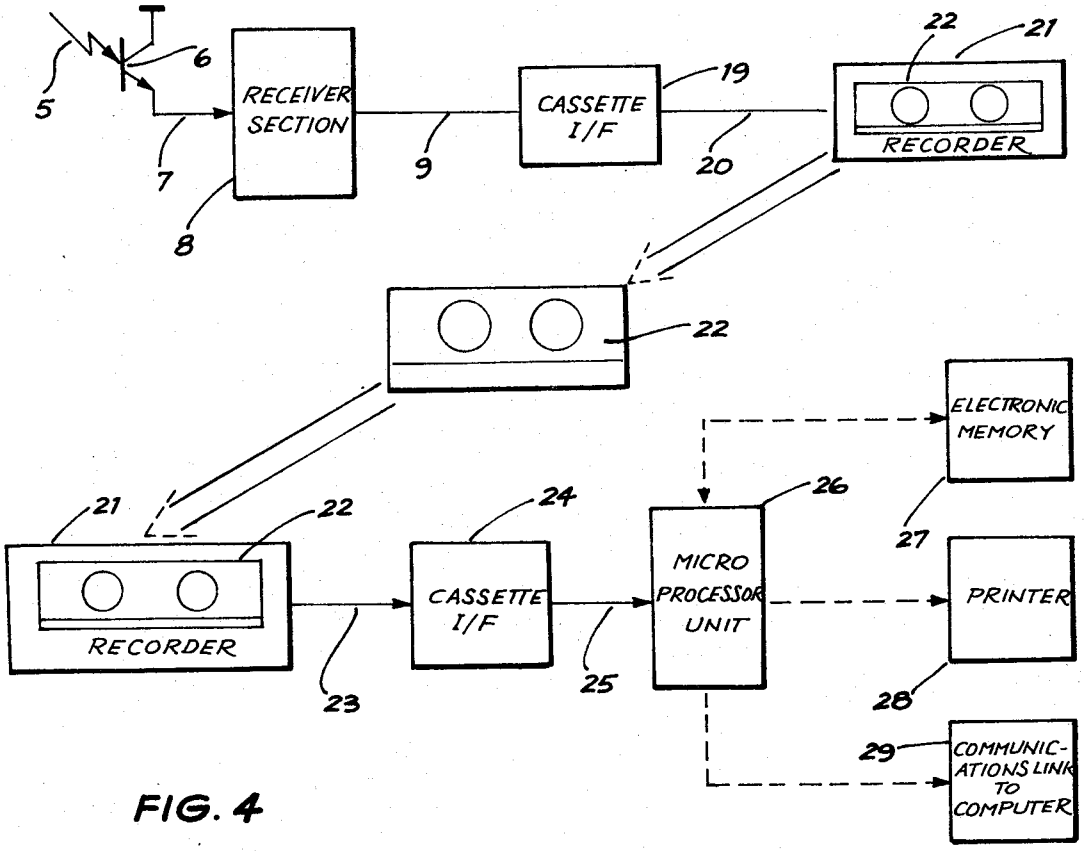
FIG. 4 illustrates a block diagram of a preferred receiver for use with the transmitter of FIG. 1.

FIG. 4 shows an arrangement similar to that of FIG. 3, but where the serial data signal 9 from the receiver section 8 is connected to a tape recorder 21 via an interface 19 such that the data can be directly recorded on cassette 22. This cassette 22 may then be replayed at a later time, the replayed signal 23 being connected to a microprocessor 26 via an interface 24 which may produce its output 25 as either a serial or parallel signal. In other respects the arrangement of FIG. 4 is similar to that of FIG. 3.

According to the preferred embodiment of the invention the receiver is substantially as described with reference to FIG. 3, but with the serial signal 9 being connected directly to the processor unit 14. The storage of data collected from the various poker machines in the system is achieved with electronic memory such as random access memory (RAM) and when the data has been collected from every machine in the system, or when the electronic memory is full, the data is transferred to a computer by connecting an output of a communications interface in the receiver to a communications port of the computer system. Once the data has been transferred to the computer, the receiver can be used to collect more data.

Figure 5:
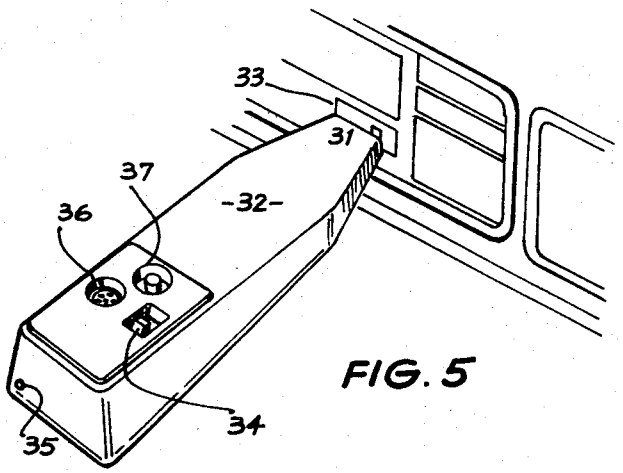
FIG. 5 illustrates a one embodiment of the receiver in use collecting data from a poker machine display.

One embodiment of the receiver is illustrated in use in FIG. 5, the photo-optic receiving device being located in an end 31 of the receiver 32 and the receiver being illustrated with the photo-optic receiving device positioned against the payout verification meter 33 of a poker machine. The control panel of the receiver 32 includes an on/off switch 34 a light emitting diode (LED) indicator 35 a communications connector 36 and a push button "read/record" switch 37 which allows transfer of data out of the hand-held receiver 32.

The receiver unit 32 is a battery operated portable unit which is placed against the verification meter of a poker machine to read the audit data which has been collected by that machine, the verification meter having a light-emitting diode display the light output of which is modulated with the audit data in response to a data signal from the poker machine's control unit. The transmission of data via the verification meter is commenced in response to the operation of a switch on the poker machine.

The data collected by the machine and which is transmitted to the data receiver 32 can include information such as the machines serial number, the number of times that doors have been opened, the number of times that the credit has been cancelled, the number of times that reel violations have been detected, and the number of times that fraudulent manipulation of coins has been detected, as well as the number of coins inserted, or paid out, the number of jackpots paid, the number of coins passed to the cash box, the number of operations of the machine, the current credit existing in the machine and information relating to time outs which have occured during operations of the machine. Each poker machine is identified by a serial number which is unique for that poker machine installation and which is set by switches located in the machine's control unit, thereby allowing data collected by the receiver to be correlated with the machine from which it was taken.

In one embodiment of the invention the procedure in collecting data from a poker machine is as follows:

| Action | Result |
|---|---|
| (a) Switch the on/off switch 34 on handset 32 to "on". | The LED indicator 35 on the handset will flash on and off once to indicate that the unit is on and that the battery is sufficiently charged. |
| (b) A key switch on the poker machine, known as the J/P keyswitch is turned on then off. | Poker machine produces a "beep" sound and the display on the verification meter 33 changes to display the machine's serial number. The machine's credit meter goes blank. |
| (c) Hold the handset 32 with its glass end against the verification meter 33 (as seen in FIG. 5). | |
| (d) Press the collect, or payout, button on the poker machine. | The poker machine will produce three "beep" sounds and then one digit on the verification meter will show "8" for a few seconds. This is followed by another beep sound and the word "zero" will then appear on both the verification meter 33 and the credit meter, indicating the end of transmission. The LED indicator 35 on the handset 32 will light up while the handset is receiving the code and will flash rapidly if the transmission was unsuccessful. |
| (e) *Remove the handset 32 from the verification meter 33 and press the collect button on the poker machine again. | Verification meter and credit meter restored to their previous readings before the audit data collection commenced. Machine is now ready to play. |

-continued

*If in step (e) the J/P key was turned on and off instead of operating the collect button, the audit data in the machine and the verification meter will be reset to zero and the credit meter will return to its previous reading.

During step (d) while the figure "8" is showing on the verification meter 33, the light output of this digit on the meter is in fact being modulated with the audit data code at high speed, causing it to flash on and off at a speed which is too fast to be seen. If the transmission was unsuccessful for some reason, the LED 35 will start flashing for a few seconds and the procedure must be repeated.

Several hundred machines can be read before the electronic storage in the handset 32 is filled with data, at which time the LED 35 will begin to flash slowly. When this happens the handset must be unloaded before more data can be collected. The handset cannot be turned off while it is holding data as the data is stored in volatile memory which will be erased if power is removed.

In order to transfer data to a computer or printer, the plug of a communications cable is inserted into socket 36 on the handset 32, the other end of the cable being connected to the computer or printer to which the data is to be transferred.

To transfer data to a computer, once the communications cable has been connected, press the read/record button 37 three times, in response to which the LED indicator 35 will flicker dimly until the data has been transferred (approx. 10–20 seconds). Transfer of data occurs at 2400 baud with seven bit words and even parity.

To transfer data to a printer, the read/record button 37 must be pressed four times in which case the LED will flicker until the entire printout is completed. The duration of this operation will depend upon the speed of the printer. If the printout is interrrupted due to a paper jam, accidental disconnection or by pressing the read/-record push button once, printout may be recommenced, at the point at which it left off, by pressing the read/record button 37 four times. For a fresh printout from the beginning the read/record push button 37 must be pressed seven times. Data transmssion is nominally at a rate of 1200 baud with eight bit words without parity, however, these transmission formats can be altered by means of switches within the hand held unit 32.

Pressing of the read/record button 37 once causes the receiver unit 32 to revert to the data collection mode, irrespective of which mode it was previously in.

If it is necessary to select different transmission formats, switches on the circuit board within the hand held unit 32 allow the selection of transmission speeds of 300, 600, 1200, 2400 and 4800 baud with odd, even or no parity and 7 or 8 bit word length. These switches are also used to control whether a carrier return only, or carriage return plus line feed codes are transmitted and whether the clear to send (CTS) line is used for hand shaking or not, a delay being inserted after carriage return when no hand shaking is used.

To transfer data to a computer using the switch selected formats the read/record button 37 must be pressed fives times, while transmission to a printer using these formats is achieved by pressing the button twice, or six times for a fresh printout.

In a preferred embodiment of the invention the transmission of data is by way of infrared light, as photo-optic receiving devices are more sensitive in the infrared region, thereby allowing the receiver unit 32 to be separated from the poker machine by a larger distance during transmission of data.

The preferred embodiment of the invention also includes a provision by which the external stimulus to the poker machine which initiates the transmission of data is provided by the receiver unit 32 rather than by the operation of a switch on the poker machine itself. The stimulus is provided by an infrared transmitter in the receiver unit 32, which produces an infrared signal in response to the operation of the push button 37 on the receiver unit. The infrared signal is detected by a photo-diode connected to the control unit of the poker machine, the control unit recognising this signal as the stimulus and commencing transmission of the audit data in response thereto. The audit data is transmitted via an infrared light emitting diode specifically provided for that purpose, rather than via the display 33 of the verification meter as as was the case with the previously described embodiment which relied on visible light transmission.

Embodiments of the invention which transmit data using infrared light and are responsive to another infrared signal for initiation of transmission will operate in a similar manner to the previously described embodiments which depend upon visible light for data transmission and the operation of a key switch to initiate transmission from the machine, except in the following respects:

1. The data collecting unit 32 is held near the poker machine, from which data is to be collected, adjacent to the poker machine's infrared transmitting and receiving devices (but not necessarily in contact therewith).
2. The push button 37 on the data collecting device is pressed once, causing an infrared transmitter in the collecting device 32 to generate the infrared signal which will initiate the poker machine's transmission sequence. This signal is received by a photo-diode in the poker machine which is connected via an interface circuit to the poker machine's control unit.
3. The control unit interprets the incoming signal and having recognised the signal as coming from the data collection unit 32 and commences transmission of the audit data via one or more infrared LEDs on the poker machine. Once the poker machine has transmitted all of the stored audit data, it reverts to the play mode.

The unloading of data stored in the hand held receiver unit of the preferred embodiment is achieved in the manner previously described with reference to FIG. 5.

It will be recognised by persons skilled in the art that numerous variations and modifications may be made to the invention as described above without departing from the spirit or scope of the invention as broadly described.

I claim:

1. A poker machine or fruit machine system comprising:

a plurality of poker machines, each having a central control unit adapted to collect and store audit data while said machine is being played, transducer means adapted to radiate a carrier signal wherein said control unit encodes said data into a form suitable for transmission and uses said encoded data to modulate said carrier signal, and switch means adapted to initiate the transmission of said data; and a hand carried portable receiver adapted to receive said carrier signal from one of said plurality of machines when the receiver is located in close proximity to said one machine and to decode the carrier signal so received to recover said transmitted data, storage means to store said recovered data with data previously recovered from others of the plurality of machines and means to transfer said stored data into an associated computer system, bulk storage system or printer.

2. The poker machine system as claimed in claim 1, wherein said transducer means includes amplitude modulation means for amplitude modulating said carrier signal by said data.

3. The poker machine system as claimed in claim 2, wherein the carrier signal is modulated with a 100% modulation ratio.

4. The poker machine system as claimed in claim 1, said carrier signal comprising visible light or infrared light.

5. The poker machine system as claimed in claim 4, wherein the transducer means comprises a light emitting diode and a modulatable power supply for said light emitting diode and the carrier signal is modulated by modulating the power supply to said light emitting diode.

6. The poker machine system as claimed in claim 5, wherein the carrier signal is modulated with a 100% modulation ratio.

7. The poker machine system as claimed in claim 1, wherein said data is encoded using ASCII code.

8. A poker machine system as claimed in claim 1, wherein the switch means adapted to initiate the transmission of data includes switch activation means responsive to an externally generated signal.

9. A poker machine system as claimed in claim 8, wherein said switch activation means is responsive to a signal comprising infrared light.

10. The poker machine system of claim 1, wherein each said transducer means is adapted to generate one or more carrier signals and each said control unit includes means for generating a corresponding number of data signals representing said encoded data and said control unit further includes:

modulating means adapted to modulate each of the carrier signals in response to a corresponding one of the data signals.

11. The poker machine system as claimed in claim 10, said carrier signals comprising acoustic tones.

12. The poker machine system as claimed in claim 10, said carrier signals comprising visible light or infrared light.

13. The poker machine system as claimed in claim 10, wherein said modulating means amplitude modulates said carrier signals and the carrier signals are amplitude modulated by respective ones of the one or more data signals.

14. The poker machine system as claimed in claim 10, wherein the one or more data signals are encoded using a Dual Tone Multi-frequency encoding system.

15. A poker machine system as claimed in claim 10, wherein the switch means adapted to initiate the transmission of data includes switch activation means responsive to an externally generated signal.

16. A poker machine system as claimed in claim 15, wherein said switch activation means is responsive to a signal comprising infrared light.

17. The system as claimed in claim 1, wherein the storage means comprises random access electronic memory and the means to transfer said stored data comprises a digital communications interface.

18. The system as claimed in claim 1, wherein the storage means comprises a magnetic disc or tape drive unit.

19. The system as claimed in claim 1 wherein switch actuation means are operably connected to said switch means, said switch actuation means responsive to an externally generated signal, and said portable receiver unit includes signal generation means for generating a signal actuable of said switch actuation means.

* * * * *